United States Patent [19]

Hampel et al.

[11] 4,429,810

[45] Feb. 7, 1984

[54] PLASTIC POUCH, AND STORING AND DISPENSING METHOD USING SAME

[75] Inventors: Gerald Hampel, Lugano-Paradiso, Switzerland; Giorgio Mugnai, Rho, Italy

[73] Assignee: W. R. Grace & Co., Cryovac Div., Duncan, S.C.

[21] Appl. No.: 410,213

[22] Filed: Aug. 23, 1982

Related U.S. Application Data

[62] Division of Ser. No. 229,437, Jan. 28, 1981, abandoned.

[30] Foreign Application Priority Data

Feb. 7, 1980 [IT] Italy ..... 19772 A/80

[51] Int. Cl.³ ..... B65D 1/32

[52] U.S. Cl. ..... 222/107; 222/567

[58] Field of Search ..... 229/62.5; 150/9; 222/92, 107, 566, 567

[56] References Cited

U.S. PATENT DOCUMENTS

| | | | |
|---|---|---|---|
| 2,707,581 | 5/1955 | Kaplan et al. | 222/107 |
| 4,028,156 | 6/1977 | Clark et al. | 222/566 X |

FOREIGN PATENT DOCUMENTS

| | | | |
|---|---|---|---|
| 560381 | 9/1957 | Belgium | 222/107 |
| 2032496 | 11/1970 | France | 222/107 |

*Primary Examiner*—F. J. Bartuska

*Attorney, Agent, or Firm*—John J. Toney; William D. Lee, Jr.; Joseph P. Harps

[57] ABSTRACT

A pouch for containing wine or other oxygen-sensitive liquid is formed from superposed layers of plastic film having welds to define a rectangular pouch with a straight-sided or shallowly tapering passage communicating a main container portion of the pouch with the exterior of the pouch. When the pouch is full, this passage is sealed off by a further weld which is removed by the consumer to allow the consumer to insert a separate valve into the pouch for dispensing of the liquid.

1 Claim, 4 Drawing Figures

PLASTIC POUCH, AND STORING AND DISPENSING METHOD USING SAME

Figure 1:
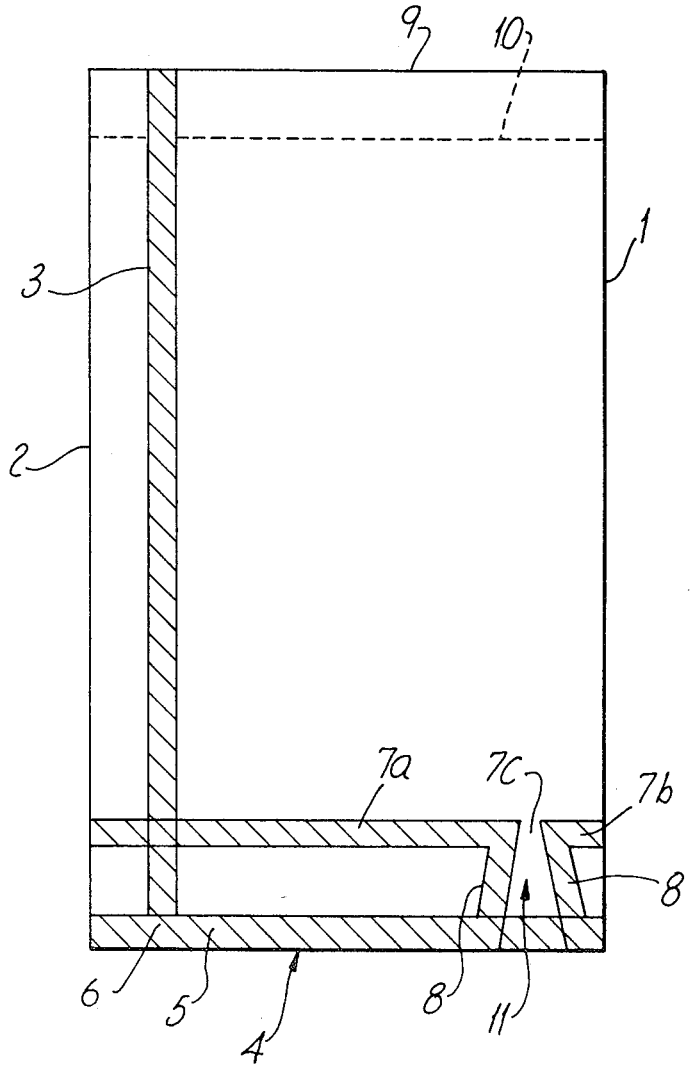

This is a division, of application Ser. No. 229,437, filed Jan. 28, 1981, now abandoned.

DESCRIPTION

The present invention relates to an improved plastic pouch for holding liquids in a hermetically sealed condition for subsequent dispensing, and to a method of storing and dispensing an oxygen-sensitive liquid, such as wine, using such a container.

It had been known, hitherto, to package wine in plastic pouches provided with integral valves and to sell the pouches, in a ready filled condition, packaged in a carton which lends support to the pouch and holds it in a readily storable configuration.

It is an object of the present invention to provide an improved pouch for storing oxygen-sensitive liquids and to provide an improved method of storing an oxygen-sensitive liquid for subsequent dispensing.

The present invention provides a hermetically sealed pouch having first and second of opposed ends and a main container portion; a first thermal seal which is adjacent to and substantially parallel to said one end; means defining an opening through said seal communicating with said main container portion; means extending from the first thermal seal at each side of said opening towards the said first end of the pouch so as to define a passageway between said main container portion and the exterior of the pouch; a liquid in said main container portion of the pouch; and a second thermal seal extending transversely to the said passageway to close it near said first thermal seal, wherein said means defining said passageway comprise pouch material bounding said passageway and one of the group comprising a pair of thermal seals and a thermal seal and a fold separated by the pouch material bounding said passageway.

A further aspect of the invention provides a valve adapted to cooperate with the above pouch to allow discharge of said liquid from the pouch, said valve having a portion insertable into said passageway to be held therein solely by adhesion to the pouch material bounding said passageway.

Yet a third aspect of the present invention provides a method of storing and dispensing an oxygen-sensitive liquid comprising the steps of: (a) partially forming a pouch having first and second ends; a main container portion; a thermal seal which is adjacent said first end substantially parallel to said first end and has an opening communicating with said main container portion; and means defining a passageway between the main container portion and the exterior of said pouch, said passageway defining means including pouch material bounding the passageway and one of the group comprising a pair of thermal seals and a thermal seal and a fold extending towards said main container portion from the first thermal seal at each side of said opening: (b) filling said pouch with said oxygen-sensitive liquid, and completing the formation of the pouch by addition of at least one further seal line; (c) storing the oxygen-sensitive liquid in said pouch until dispensing of the liquid is required; (d) when it is desired to dispense the liquid from said pouch attaching a valve to said pouch by insertion of a portion of the valve into said passageway for retention engagement with the passageway solely by adhesion to said pouch material bounding the passageway; and (e) after dispensing the contents of said pouch discarding the pouch but salvaging the valve for re-use, wherein the said pouch has an oxygen-barrier layer of a material given better oxygen-barrier characteristics than the material of said valve.

Figure 2A:
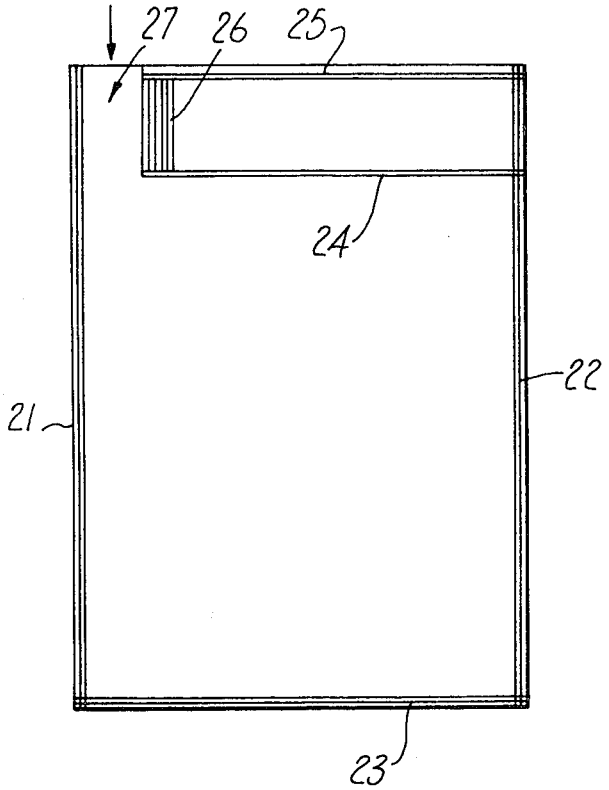
Figure 2B:
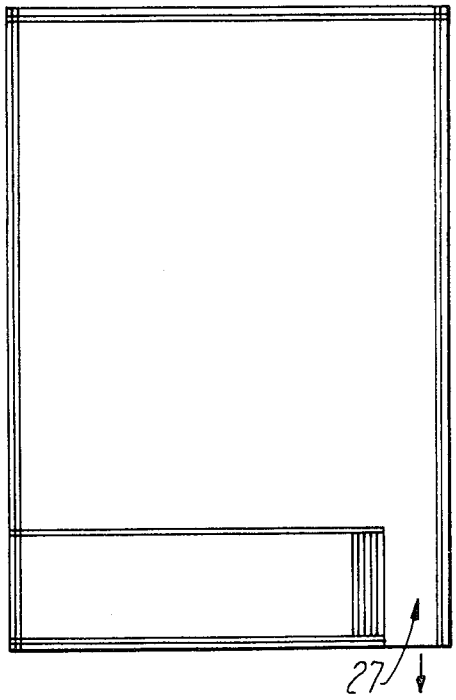
Figure 3:
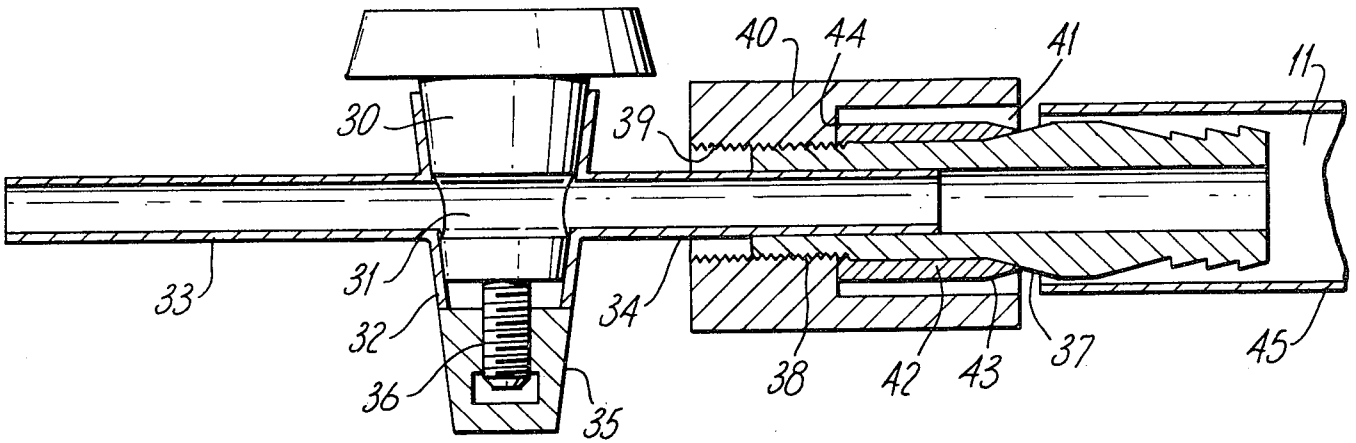

The following description is given, as an exemplification of the invention, with reference to the accompanying drawings in which:

FIG. 1 is a view of a plastic pouch for liquid storage, showing the seal lines used in forming the bag;

FIG. 2*a* shows an alternative form of pouch having a modified configuration of valve-receiving passage;

FIG. 2*b* shows the pouch of FIG. 2*a* in the position of use for dispensing liquid therefrom; and FIG. 3 is a longitudinal sectional view of a valve for use with the pouch of FIGS. 2*a* and 2*b*.

Referring now to the drawings, FIG. 1 shows a multilayer plastic pouch for storing liquid, for example wine.

The pouch is, in this case, made from a centre-folded web of plastics material having the fold line 1 defining an edge of the pouch and the opposite edge 2 of the pouch closed by means of a longitudinal seal 3 running the full length of the pouch.

One end 4 of the pouch is sealed by way of an outer seal line 5 extending the full width of the pouch and hence intersecting the longitudinal seal line 3 at 6.

The end seal line 5 is complimented by a broken inner seal line 7*a*, 7*b* having an opening 7*c* therebetween to define a discharge passage 11 for the liquid to be dispensed. The sides of the liquid-dispensing package are completed by two further seal lines 8 which extend in shallowly divergent arrangement along the pouch from the respective inner seal line portions 7*a*, 7*b* towards, and in this case up to, the outer seal line 5 so that, in the configuration shown in FIG. 1, the pouch is closed at the bottom end by virtue of the end seal line 5. It is of course possible to open the liquid discharge passage 11 simply by cutting away the plastic material forming the end seal line 5, whereupon the opening 7*c* in the inner end seal line 7*a*, 7*b* and the passage 11 will provide access to the contents of the pouch.

It is envisaged that the pouch shown in FIG. 1 will be filled through the upper end 9 before subsequent sealing by way of a seal line (not shown) arranged to extend along the region illustrated by the broken line 10 in FIG. 1. Alternatively the pouch may be filled by way of the discharge passage 11.

It is furthermore envisaged that the pouch of FIG. 1 may be completed, before filling, with its additional seal line along the line 10, in which case the end seal line 5 will have been omitted, leaving the passage 11 defined between the two oblique longitudinal seal lines 8 free for filling the bag. After filling, the end seal line 5 will be formed to close the pouch hermetically.

In the preferred examples the various seals are made by heat sealing, in a temperature range of 110° to 150° C. The width of each seal line is from 5 to 8 millimeters. Other sealing conditions are possible within the scope of this invention.

For storing and dispensing liquids such as wine, which are known to deteriorate in the presence of oxygen, it is necessary to ensure that the material of the pouch has adequate oxygen-barrier characteristics. However, it is also necessary for the pouch to have the required strength of abuse-resistance and for this reason it is necessary to select a material for the bag which has the required degree of tolerance to pinching and exposure to sharp edges, for example resulting from contact with the edges of flaps or panels of a cardboard outer carton. Additionally, the material of the pouch wall must be inert to the liquid contents of the pouch and must be capable of sealing to itself with the required degree of reliability in the pouch-forming process.

In order to satisfy these three requirements, we propose to employ a composite structure, in this case one employing a sealing film having the required sealability and inertness to the pouch contents, an outer film providing the required abuse-resistance, and an oxygen-barrier film in order to prevent the liquid within the pouch from becoming exposed to oxygen over prolonged periods of storage, and, optionally, an intermediate film between the barrier and sealing films. The material of at least one of the films of the pouch may also be dark-pigmented in order to prevent exposure of the pouch contents to daylight as this is known to promote deterioration of some wines. Such pigmentation is not necessary where the bag is supplied in an opaque container such as a cardboard box.

The sealing film is envisaged as being either of polyethylene or of an ethylene-vinyl acetate copolymer, for example with a vinyl acetate component of from 5 to 18%, preferably 9%. For some packaging purposes it is necessary to ensure that only polyethylene is used as the sealing layer for contact with the liquid contents. Other possible sealing film materials include ionomeric resins such as SURLYN (a Registered Trade Mark of E I Du Pont De Nemours & Co), Ethylene-methylacrylate copolymers, and mixtures of the above materials. In order to ensure that the finished pouch is as flexible as possible, both from the point of view of filling a storage carton to the best possible degree, and from the point of view of having the delivery passage 11 as flexible as possible for receiving a dispensing valve to be attached by the consumer, it is preferred that only one sealing layer is used, for example one having a thickness in the range 40 microns. However, thicker sealing layers can be used if necessary.

The intermediate film is preferably a 40 micron thick layer of Ethylene-Vinylacetate copolymer having a 9% Vinylacetate component.

The preferred barrier film is one which includes a mixture of mostly vinylidene chloride chloride copolymer, but with minor proportions of chlorinated paraffins, epoxy resins, and other auxiliaries to plasticize and stabilise the polymer to the minimum content necessary to give a processable material, bearing in mind that the presence of plasticizers and stabilizers tends to increase the oxygen permeability, although this tendency is least where chlorinated paraffins are concerned. For example, the vinylidene chloride-vinyl chloride copolymer may account for 91.5% to 89% of the total, the chlorinated paraffins for 5% to 6%, the epoxy resins for 3% to 4% and the "other auxiliaries" from 0.5% to 1%.

The barrier film may for example be a three ply coextruded laminate comprising (a) a 22 micron layer of a copolymer of Ethylene-Vinylacetate with a vinylacetate component of 18%, (b) a 30 micron layer of a copolymer of vinylidene chloride-vinylchloride, and (c) a 23 micron layer of Ethylene-Vinylacetate copolymer with an 18% vinylacetate component.

Generally, the thickness of the barrier film is at least 30 microns and up to 75 microns. The oxygen-permeability of a 30 micron layer of mainly vinylidene chloride-vinyl chloride copolymer is approximately 10 milliliters per $m^2 \times$atmosphere$\times$day, whereas the oxygen permeability of a 60 micron thick layer will be half this value, approximately 5 milliliters per $m^2 \times$atmosphere$\times$day. Other barrier film compositions include Vinylidene chloride-vinyl-chloride copolymers, or Ethylene-vinylalcohol copolymers, or Polyvinylalcohol, or Acrylonitrile based resins, or Polyamides, or Polyesters, or Metallized substrates.

Two layers of barrier material can be used where particularly low values of oxygen permeability are required.

In order to protect this oxygen-barrier layer against abuse, an outer film of a suitable material is employed. The preferred outer film in this case is a laminate of a Bioriented Nylon 6 layer (18 microns thick) with a layer of low density Polyethylene (15 microns thick). Another suitable abuse-resistant film material would be ethylene-vinyl acetate, again with a vinyl acetate component of from 5 to 18%, preferably approximately 10% of the total. These materials are particularly advantageous in that, while imparting the required abuse-resistance characteristics, they nevertheless have good flexibility characteristics and thus the entire composite film structure consisting of the inner film, the abuse resistant outer film (of ethylenevinyl acetate or of nylon-polyethylene laminate) and the multi-component barrier film constitutes a relatively flexible film structure which will lend itself to subsequent attachment of a dispensing valve by the consumer. The flexibility is enhanced when the four film elements are not bonded together. The flexibility of the pack helps in allowing the pouch material to collapse readily as the wine or other contained liquid is withdrawn through the valve by the consumer. The thickness of the ethylene-vinyl acetate abuse-resistant film may be similar to that of the sealing film, or may be a greater thickness if desired.

As indicated above, the composite film structure having the above three functional film layers and the optional fourth intermediate film is formed as a centre-folded laminated web. However, there is no bonding between the individual layers of the web until the web is sealed, so that each wall of the pouch consists of three separate independent layers of plastics material having the desired properties at each section through the wall. As mentioned above, avoiding bonding together the layers of the composite film structure has the advantage of enhancing the flexibility of the composite structure in that the layers are able to slide over one another during bending of the structure. However, the various sub layers making up the abuse-resistant film (where this is a Nylon 6 Polyethylene laminate), will be bonded to one another, and so will those of the barrier film.

Generally, there is no limit on the number of layers used for the film structure provided the various functional requirements are met.

The precise construction of the valve for use with the pouch in accordance with the present invention is not important. However, it is essential that the valve for use with the pouch illustrated in FIG. 1 should have a tapering (usually conical) plug portion which can engage in the tapering passage 11 of the pouch after removal of the end seal line 5.

In practice, the pouch consisting of the pouch, with or without its enveloping carton, will be arranged such that the discharge passage 11 is at the upper part of the pouch and then the consumer can cut away at least that part of the end seal line 5 which closes the passage 11. This then allows the tapering plug of the valve to be pushed into the passage 11 until the conical wall of the plug intimately grips the conical passage formed by the layers of web material between the two shallowly divergent longitudinal seal lines 8.

Such a pack, for use as a wine container, has particular advantages in that the discharge valve is supplied separate from the pouch and can be inserted by the consumer when the contents of the pouch are to be dispensed. Thus, until the time of dispensing the contents, the oxygen-barrier characteristics of the intermediate layer of the pouch walls, coupled with the reliable seals extending round three sides of the pouch and the existence of the centre fold along the fourth side of the pouch, helps to maintain the wine or other liquid contents of the pouch substantially oxygen-free. This means that the material used for the valve need not have high oxygen-barrier characteristics and thus the design of the valve can be chosen such that it is readily operable without any undue friction of the moving parts of the valve where an on-off tap type of valve is used. Another advantage is that because one valve will be supplied to the consumer for use with any number of separate pouches the construction of valve used can be one which is slightly more costly than would be chosen where the valve is a disposable item, and nevertheless the overall cost to the consumer can be kept down.

Conventional wine pouches are supplied complete with some form of discharge valve, often a bung and neck arrangement which needs to be welded to the multi-function material of the pouch wall. The reliability of such seals is often difficult to achieve and it is particularly advantageous for the valve to be supplied separately from the pouch and to be attached to the pouch in a secure way by the consumer at the location of use. There is thus no need to achieve a bonding of the valve to the pouch which will be capable of withstanding transit shocks on the filled pouch. Also, the materials most suitable for the discharge valve do not have very favourable oxygen-barrier characteristics.

A further embodiment of pouch is illustrated in FIG. 2*a* and consists of two identical sheets of multi-function material, arranged with the desired "sealing layers" in face contact to define the chemically inert inner face of the finished pouch, and the pouch is then formed by seal lines 21 and 22 extending along the full length of the pouch and an end seal line 23 extending across the full width of the pouch at one end. The other end of the pouch is sealed by a pair of parallel partial seal lines 24 and 25 and a further passage-defining seal line 26 joining the end seal 25 to the parallel inner seal line 24, thereby leaving a discharge passage 27 at one corner of the pouch. In this case the discharge passage 27 is parallel-sided for receiving a suitable valve-mounting plug to be inserted by the consumer. Although, from the point of view of sealing the pouch in an oxygen-tight manner the seal line 25 shown in FIGS. 2*a* and 2*b* appears to be redundant, the filling of the pouch is easier when the seal line 25 has been formed.

FIG. 2*a* shows this alternative embodiment of pouch in the orientation in which it is to be filled; the final step of the filling process will involve sealing the upper end of the passage 27 by forming a continuation of the outer end seal line 25 to meet up with the side seal line 21.

FIG. 2*b* shows the same pouch, after inversion and opening of the passage 27, although of course it will be appreciated that by the time the pouch is inverted into this configuration a valve, not shown in FIG. 2*b*, will have been inserted in the passage 27.

It is of course possible for the pouch shown in FIGS. 2*a* and 2*b* to be formed of centre-folded multi-function film as was the described case in connection with FIG. 1, and equally it is possible for the pouch of FIG. 1 to have been made without any fold in the web, as described in conjunction with FIGS. 2*a* and 2*b*.

A particularly convenient construction for the dispensing valve for use with the straight-sided discharge passage 27 in the pouch of FIGS. 2*a* and 2*b* is shown in longitudinal sectional view in FIG. 3. The components of this valve comprise a rotor 30 having a transverse bore 31 and housed in a stator member 32 which has a discharge pipe 33 at one side and a coaxial fitting 34 of the same diameter as the discharge pipe at the other side. The rotor 30 is of conical construction and is held in engagement with a conical recess of the stator 32 by way of a nut 35 screwed onto a shank 36 of the rotor. This allows the sealing fit of the rotor body 30 in the stator 32 to be adjusted if necessary.

In order to mount this valve on the cylindrical passage portion of a pouch, the valve has a mounting fitting consisting of an internally cylindrical but externally biconical sleeve 37 having one end threaded at 38 to engage in a threaded opening 39 of a nut 40. The other end of the nut 40 has an enlarged bore 41 housing a clamping sleeve 42 chamfered internally and externally at one end 43 and plain-ended at the other end 44 where it engages the step between the bore 41 and the opening 39 of the nut 40. The annular space between the external surface of the clamping sleeve 42 and the adjacent inwardly facing cylindrical surface of the bore 41 is sufficient to receive an end of the pouch discharge passage wall 45.

In order to attach the valve to the outlet passage wall 45 of the pouch shown in FIGS. 2*a* and 2*b*, once the seal line 26 and the seal (not shown in FIGS. 2*a* and 2*b*) closing the passage have been severed, the biconical portion of the sleeve 37 is entered into the discharge passage 27 until the wall 45 of the passage enters the annular space between the external surface of the clamping sleeve 42 and the inwardly facing surface of the wall of bore 41. It is necessary to trim surplus material from the exterior of the seal line 261 for example resulting from an imprecise cut along seal line 26, before or after insertion of the sleeve 37 into the discharge passage 27 of the bag, and then merely to screw the nut 40 rightwardly along the sleeve 37 thereby spreading the chamfered end 43 of the clamping sleeve 40 as it rides up over the cooperating conical face of the biconical portion of the sleeve 37 and presses the wall material 45 sealingly against the wall of the bore 41. In this way the clamping of the wall material 45 takes place without undue rucking of the material and without localised pinching which would run the risk of rupturing the neck.

Once the valve has been attached in this way it is possible to rotate the rotor 30 to open and close the valve, as desired.

In use of the wine pouch according to either of the embodiments illustrated, the pouch is first of all made by a multiple sealing process, but left so that there is an opening through which wine can be introduced. This opening may either be the aperture through which eventually the wine is to be discharged, or (for example as in the case of the pouch shown in FIG. 1) may be some other portion of the pouch.

The pouch is then placed in an enclosing carton for purposes of supporting the contents and is then connected to a filling line through which wine may be introduced into the pouch. Alternatively the pouch may be filled before being placed in the carton.

It is envisaged that the pouch may be produced in various different sizes, for example a 5 liter, a 10 liter, a 20 liter, and a 30 liter size (the dimensions of the flat pouch being adjusted to give the appropriate volume). As an example, a 5 liter pouch may have a length of 465 millimeters and a width of 306 millimeters (giving net dimensions within the seal lines of 415 by 300 millimeters) and a 30 liter pouch may have gross dimensions of 740 by 570 millimeters, giving a net dimension of 690 by 560 millimeters.

The pack consisting of the filled pouch in the carton is delivered to the consumer, after prolonged storage if necessary, and the consumer will also be sold a valve for use with the particular type of discharge passage provided on the pouch. The consumer can then store the wine still further until he needs to use the contents of any particular pouch, whereupon he then arranges the container so the discharge passage is uppermost and then cuts the seal closing the end of the discharge passage. In the case of pouch of FIG. 1 the valve will have a conical end fitting matched to the taper of the discharge passage 11 and the consumer will simply push the conical plug fitting of this valve into the passage until it is a tight fit and no wine can leak between the exterior of the valve plug and the interior of the discharge passage.

In the case of the pouch illustrated in FIGS. 2*a* and 2*b* the consumer will simply ensure that the nut 40 is unscrewed as far as possible before inserting the valve fitting into the passage 27 until the wall 45 of the passage has entered the space between the bore 41 and the exterior of the clamping ring 42, and then the consumer simply needs to screw up the nut 40 to clamp the valve in position.

Once the contents of a particular pouch have been consumed, the consumer will detach the valve and then dispose of the pouch and carton, leaving the valve ready for use on the next pouch to be opened.

As indicated above, the preferred construction of pouch uses a single barrier layer with flexible inner and outer layers to the multi-function web material. However, it is known that the oxygen permeability of a given thickness of material can be enhanced if that thickness is constituted by two thinner sheets placed in loose contact with one another and thus it is within the scope of the present invention to employ more than one barrier layer, if required.

The liquids with which the above disclosed pouch and method may be used include not only wine, but other oxygen-sensitive liquids such as photographic developers and other chemical solutions.

Practical tests on two 5 liter pouches, one equipped with a valve and one sealed without the valve, has revealed that the oxygen permeability of the valved pouch was in the range 20 to 30 ml per day, whereas the oxygen permeability of the unvalved pouch was approximately 1 ml per day.

We claim:

1. A valve and pouch combination wherein said valve is adapted to cooperate with and dispense liquid from said pouch comprising:

(a) a hermetically sealed pouch of flexible, thermoplastic material having first and second closed ends and a main container portion comprising:
  (i) a first thermal seal which is adjacent to and substantially parallel to said first end;
  (ii) a pair of parallel partial seal lines sealing the second end of said pouch;
  (iii) a passage defining seal line joining the ends of said pair of parallel partial seal lines said passage communicating with said main container portion;
  (iv) a liquid in said main container portion of the pouch; and,
  (v) said passageway being adapted to receive a biconical mounting portion of a dispensing valve when liquid is being dispensed from the pouch; and, (b) valve means adapted to co-operate with said pouch and allow discharge of liquid from said pouch comprising;
  (i) a valve portion insertable into said passageway to be held there solely by adhesion to the pouch material bounding said passageway;
  (ii) said portion of said valve which is insertable in said passageway being biconical; and,
  (iii) said valve including inner and outer spaced cylindrical surfaces defining therebetween an annular gap to receive the pouch material bounding said passageway and further including outwardly spreadable clamping means for diminishing the radial extent of said annular gap to clamp said valve to the pouch material bounding the passageway.

* * * * *